US009014585B2

(12) United States Patent
Washington et al.

(10) Patent No.: US 9,014,585 B2
(45) Date of Patent: Apr. 21, 2015

(54) SYSTEM AND METHOD FOR DETECTING BIAS TRANSFER ROLL POSITIONS USING RESISTANCE DETECTION

(71) Applicant: Xerox Corporation, Norwalk, CT (US)

(72) Inventors: John Washington, Hertfordshire (GB); John Buzzelli, Walworth, NY (US); Karl Kurz, Rochester, NY (US); Allen Thompson, Sodus, NY (US)

(73) Assignee: Xerox Corporation, Norwalk, CT (US)

( * ) Notice: Subject to any disclaimer, the term of this patent is extended or adjusted under 35 U.S.C. 154(b) by 7 days.

(21) Appl. No.: 13/839,711

(22) Filed: Mar. 15, 2013

(65) Prior Publication Data

US 2014/0270829 A1 Sep. 18, 2014

(51) Int. Cl.
*G03G 15/16* (2006.01)

(52) U.S. Cl.
CPC .... *G03G 15/1605* (2013.01); *G03G 2215/0193* (2013.01)

(58) Field of Classification Search
CPC ..... G03G 15/0131; G03G 15/0136; G03G 15/1605; G03G 15/1615
USPC ..... 399/13, 66, 121, 298, 299, 302
See application file for complete search history.

(56) References Cited

U.S. PATENT DOCUMENTS

| | | | | |
|---|---|---|---|---|
| 2,912,586 | A | 11/1959 | Gundlach | |
| 3,781,105 | A | 12/1973 | Meagher | |
| 4,851,960 | A | 7/1989 | Nakamura et al. | |
| 5,164,779 | A | 11/1992 | Araya et al. | |
| 5,321,476 | A | 6/1994 | Gross | |
| 5,420,677 | A | 5/1995 | Gross et al. | |
| 5,613,173 | A | 3/1997 | Kunzmann et al. | |
| 5,849,399 | A | 12/1998 | Law et al. | |
| 6,600,895 | B2 | 7/2003 | Fletcher et al. | |
| 6,606,477 | B2 | 8/2003 | Thompson et al. | |
| 6,611,655 | B1 | 8/2003 | Murase et al. | |
| 7,062,186 | B2 | 6/2006 | Kyung | |
| 7,177,572 | B2 | 2/2007 | DiRubio et al. | |
| 7,187,877 | B2 * | 3/2007 | Yamaguchi | 399/37 |
| 7,512,367 | B2 | 3/2009 | Parks | |
| 7,747,210 | B2 | 6/2010 | DiRubio | |
| 7,881,634 | B2 * | 2/2011 | Zensai | 399/121 |
| 2006/0056883 | A1 | 3/2006 | Watanabe et al. | |
| 2008/0219714 | A1 | 9/2008 | Mashtare et al. | |
| 2009/0028608 | A1 | 1/2009 | Takashima | |

* cited by examiner

*Primary Examiner* — William J Royer
(74) *Attorney, Agent, or Firm* — Fay Sharpe LLP

(57) ABSTRACT

A system and method is provided for determining the location of one or more biased transfer rolls relative to associated photoreceptors in a printer. The one or more biased transfer rolls can be moved into contact with an intermediate transfer surface bringing the surface into contact with associated photoreceptors to form a closed biased transfer roll image transfer nip for transferring an image from the photoreceptor to the intermediate transfer surface. The open or closed condition of the biased transfer roll image transfer nip is determined by applying a constant current to the biased transfer roll and evaluating a voltage at the biased transfer roll. The open or closed condition of different image transfer nips can be determined in a similar manner. A plurality of biased transfer rolls can be ganged together for simultaneous movement with respect to associated photoreceptors to form a plurality of image transfer nips, the open and closed condition which can also be determined.

20 Claims, 6 Drawing Sheets

SYSTEM AND METHOD FOR DETECTING BIAS TRANSFER ROLL POSITIONS USING RESISTANCE DETECTION

BACKGROUND

Disclosed in embodiments herein are methods and apparatuses relating to an image forming machine, and more particularly, to determining the location of one or more biased transfer rolls relative to associated photoreceptors in a printer.

A typical electrophotographic, or xerographic, printing machine employs a photoreceptor, that is charged to a substantially uniform potential so as to sensitize a photoconductive surface thereof. The charged portion of the photoreceptor is exposed to a light image of an original document being reproduced. Exposure of the charged photoreceptor selectively dissipates the charge thereon in the irradiated areas to record an electrostatic latent image on the photoreceptor corresponding to the image contained within the original document. After the electrostatic latent image is recorded on the photoreceptor, the latent image is developed by bringing a developer material into contact therewith. Generally, the electrostatic latent image is developed with dry developer material, referred to as toner, comprising toner particles which are attracted to the latent image, forming a visible toner image on the photoconductive surface.

The toner image can then be transferred to an intermediate transfer surface at a biased transfer roll image transfer nip formed by an electrically biased transfer roll pressing the intermediate transfer surface against the photoreceptor. This serves to effect combined electrostatic and pressure transfer of toner images from the photoreceptor to the intermediate transfer surface. A high voltage power supply provides an electrical bias of a suitable magnitude and polarity so as to electrostatically attract the toner particles from the photoreceptor to the intermediate transfer surface to form the toner image on the intermediate transfer surface. Multiple toner images, each corresponding to a different color separation, can be transferred to the intermediate transfer surface to form a multi-color toner image. The toner image is then typically transferred to a substrate, such as paper and the like, to form a printed image.

The biased transfer roll can be moved away from the intermediate transfer surface, for various printing and non-printing conditions, and thus, it is desirable to determine the location of the biased transfer roll so as to enable image transfer, when so desired. Typically, optical sensors are used for this purpose. However, these sensors add additional costs and complexity to the printer.

Biased transfer roll assembly resistivity measurement routines have been used to determine various properties of the biased transfer roll, intermediate transfer surface, photoreceptor, and/or biased transfer roll image transfer nip. It is desirable to utilize biased transfer roll assembly resistivity measurement for determining the location of the biased transfer roll with respect to the image transfer surface and photoreceptor.

DETAILED DESCRIPTION

A system and method is provided for determining the location of one or more biased transfer rolls relative to one or more photoreceptors for use in determining the open or closed condition of one or more biased transfer roll image transfer nips.

Figure 1:
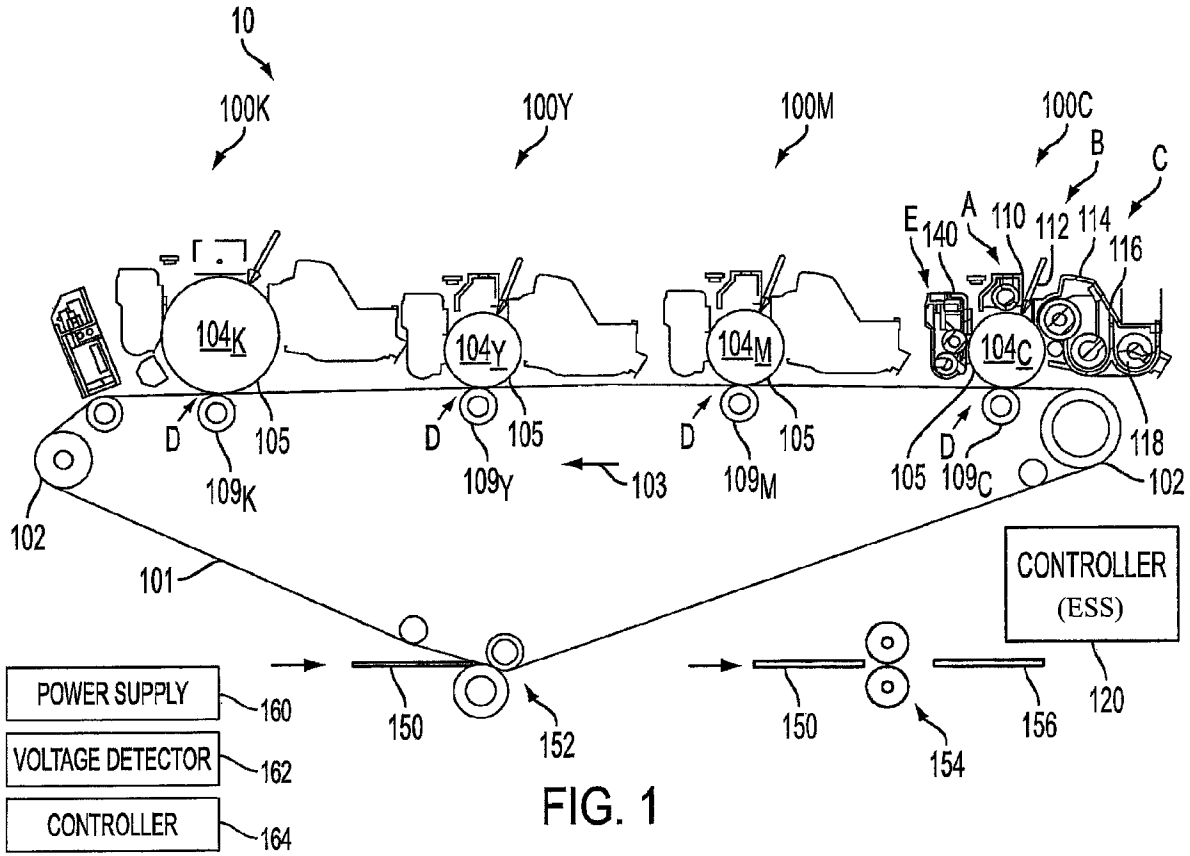
FIG. 1 illustrates a color printer according to an exemplary embodiment of this disclosure.

Referring to FIG. 1, a printer having the features described herein is shown generally at 10. The printer 10, can be a xerographic or electrophotographic image forming device such as a multi-color digital printer, a digital color copy system, or the like. It includes a plurality of marking engines, 100K, 100C, 100M, 100Y, forming associated color separations that are combined to form a color print image, as described in further detail below.

The printer 10, shown by way of example, is a tandem architecture system including an intermediate transfer surface, such as for example intermediate transfer belt 101, entrained about a plurality of rollers 102 and adapted for movement in a process direction illustrated by arrow 103. The intermediate transfer belt 101 is adapted to have transferred thereon a plurality of toner images, which are formed by the marking engines 100K, 100C, 100M, 100Y.

Each marking engine 100K, 100C, 100M, 100Y forms an associated color separation by developing a single colorant toner image in succession on the intermediate transfer belt 101 so that the combination of the color separations forms a multi-color composite toner image. While the color separations may be combined in different ways, they are each separately developed onto associated photoreceptors and then transferred to a compliant single-pass intermediate transfer belt 101. When all of the desired color separations have been built up on the intermediate transfer belt 101, the entire image is transfixed to a substrate, such as paper, to form a print image.

For the purposes of example, which should not be considered limiting, the printer or image forming machine 10 described herein is a CMYK marking system having four marking engines 100K, 100C, 100M, 100Y which include: a cyan marking engine 100C forming a cyan color separation; a magenta marking engine 100M forming a magenta color separation; a yellow marking engine 100Y forming a yellow color separation; and a black marking engine 100K forming a black separation. However, it should be appreciated that a larger or smaller number of marking engines 100 can be used.

Each marking engine 100C, 100M, 100Y and 100K includes a charge retentive member in the form of a drum-shaped photoreceptor 104C, 104M, 104Y and 104K, having a continuous, radially outer charge retentive surface (photoreceptor surface) 105 constructed in accordance with well known manufacturing techniques. The photoreceptor 104C, 104M, 104Y and 104K is supported for rotation such that its surface 105 moves past a plurality of xerographic processing stations A, B, C, D, and E in sequence.

Initially, successive portions of the photoreceptor surface 105 pass through a first charging station A. At charging station A, a corona discharge device indicated generally at 110, charges portions of the photoreceptor surface 105 to a relatively high, substantially uniform potential during a charging operation.

Next, the charged portions of the photoreceptor surface 105 are advanced through a first exposure station B. At first exposure station B, the uniformly charged photoreceptor surface 105 is exposed to a scanning device 112 that causes the photoreceptor surface 105 to be discharged forming a latent image of the color separation of the corresponding engine. The scanning device (ROS) 112 can be a Raster Output Scanner (ROS), non-limiting examples of which can include a Vertical Cavity Surface Emitting Laser (VCSEL), an LED image bar, or other known scanning device. The ROS 112 is controlled by a controller 120 to discharge the photoreceptor surface 105 in accordance with the digital color image data to form the latent image of the color separation. A non-limiting example of the controller 120 can include an Electronic Subsystem (ESS) shown in FIG. 1, or one or more other physical control devices. The controller 120 may also control the synchronization of the belt movement with the marking engines 100C, 100M, 100Y and 100K so that toner images are accurately registered with respect to previously transferred images during transfer from the latter to the former.

The marking engines 100C, 100M, 100Y and 100K also include a development station C, also referred to as a developer 114. The developer 114 includes a housing 116 holding toner 118 having a color (i.e. cyan, magenta, yellow or black) specific to the associated marking engine 100C, 100M, 100Y and 100K. The developer 114 includes a magnetic brush, roller, or other toner applicator advancing the toner 118 into contact with the electrostatic latent images on the photoreceptor 104C, 104M, 104Y and 104K to form the toner image for the associated color separation as controlled by controller 120.

Figure 2A:
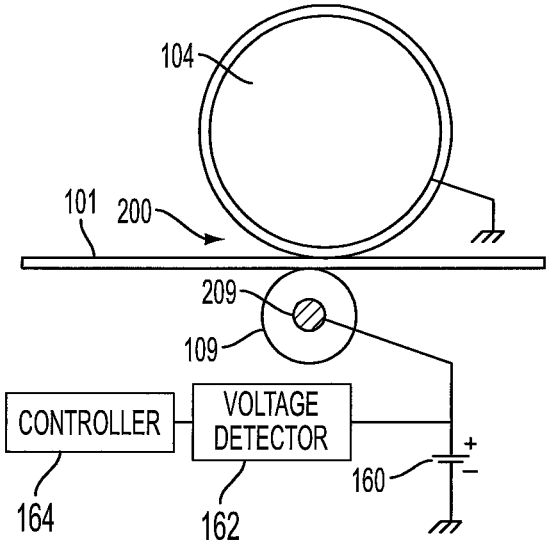
FIG. 2A illustrates a biased transfer roll assembly in a contact position for use in the color printer of FIG. 1.

The toner image is then transferred to the intermediate transfer belt 101 at a transfer station D, which is shown in further detail in FIG. 2A. At this location, an electrically biased transfer roll (BTR) 109 contacts a backside of the intermediate transfer belt 101, urging the opposite side (i.e. the front side) of the intermediate transfer belt 101 into contact with the photoreceptor surface 105 of the photoreceptor 104C, 104M, 104Y and 104K to form a closed BTR image transfer nip, shown at 200. In the closed condition, the closed BTR image transfer nip 200 serves to effect combined electrostatic and pressure transfer of toner images from the photoreceptor 104C, 104M, 104Y and 104 of the marking engine to the intermediate transfer belt 101. A high voltage power supply 160 provides an electrical bias of a suitable magnitude and polarity so as to electrostatically attract the toner particles from the photoreceptor 104C, 104M, 104Y and 104K to the intermediate transfer belt 101 to form the toner image of the associated color separation on the intermediate transfer belt 101.

After the toner images are transferred from the photoreceptor 104C, 104M, 104Y and 104K, the residual toner particles carried by the non-image areas on the photoreceptor surface 105 are removed from it the photoreceptor surface 105 at cleaning station E, where a cleaning housing 140 includes cleaning brushes which remove the toner from the photoreceptor surface 105.

After all of the toner images have been transferred from the marking engines 100C, 100M, 100Y, 100K, to the intermediate transfer belt 101, the multi-color composite toner image is transferred to a substrate 150, such as plain paper, by passing through a conventional transfer device 152. The substrate 150 may then be directed to a fuser device 154 to fix the multi-color composite toner image to the substrate 150 to form a color print 156.

Figure 2B:
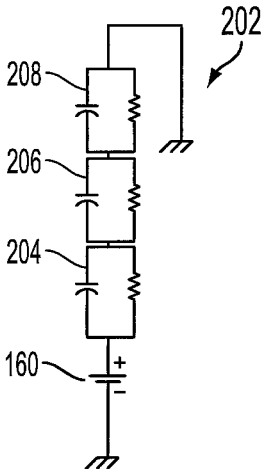
FIG. 2B illustrates an electrical circuit of the biased transfer roll assembly shown in FIG. 2A.

When the BTR closed image transfer nip 200 is in the closed condition during image transfer, an electrical circuit 202 is completed from the output of the power supply 160 through a metal shaft 209 of the biased transfer roll 109 to the intermediate transfer belt 101 to the photoreceptor 104C, 104M, 104Y and 104K to ground, as shown at 202 in FIG. 2B. This electrical circuit 202 includes resistive and capacitive elements of the biased transfer roll 109 represented at 204, resistive and capacitive elements of the intermediate transfer belt 101 represented at 206, and resistive and capacitive elements of the photoreceptor 104C, 104M, 104Y and 104K represented at 208.

Figure 3A:
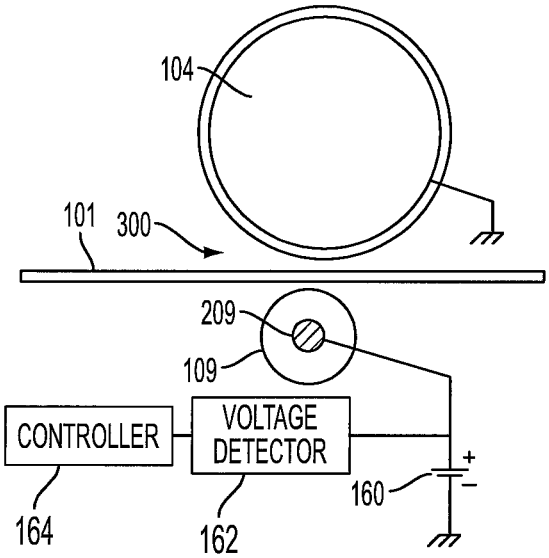
FIG. 3A illustrates a biased transfer roll assembly in a non-contact position for use in the color printer of FIG. 1.

The BTR 109 can be moved away from the intermediate transfer belt 101 to a non-contact position in which the intermediate transfer belt 101 is no longer pressed against the photoreceptor 104C, 104M, 104Y and 104K, thereby forming an open BTR image transfer nip as shown generally at 300 in FIG. 3A. This configuration can be used to increase the useful life of the BTR 109, intermediate transfer belt 101 and photoreceptor 104C, 104M, 104Y and 104K when the associated marking engine 100K, 100C, 100M, 100Y is not used. In one example, which should not be considered as limiting, biased transfer rolls $\mathbf{109}_C$, $\mathbf{109}_M$, $\mathbf{109}_Y$, of the respective three color marking engines 100C, 100M, and 100Y can be moved to the non-contact position to form open CMY BTR image transfer nips 300 when printing in black and white mode. Alternatively, the biased transfer roll $\mathbf{109}_K$ of the black marking engine $\mathbf{109}_K$ can be moved to the non-contact position to form an open black BTR image transfer nip 300 when printing in process color mode.

Referring to FIG. 3A, the electrical circuit formed by an open BTR image transfer nip 300, is shown generally at 302. This electrical circuit 302 includes the biased transfer roll resistive and capacitive elements 204, intermediate transfer belt resistive and capacitive elements 206 and photoreceptor resistive and capacitive elements 208 being out of electrical contact with each other, thereby forming an open circuit.

Figure 4:
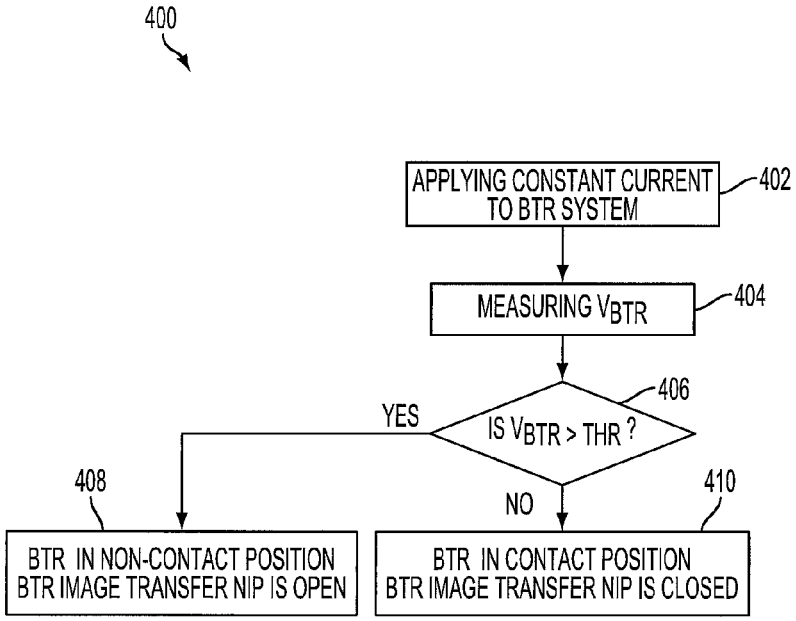
FIG. 4 illustrates method of determining the position of a biased transfer roll.

Referring now to FIG. 4, a method of determining the position of the biased transfer roll 109 is shown generally at 400. The method 400 includes connecting the power supply 160 operating in constant current mode to the biased transfer roll 109 at 402. In one non-limiting example, the power supply 160 can be the printer's high voltage power supply.

Figure 3B:
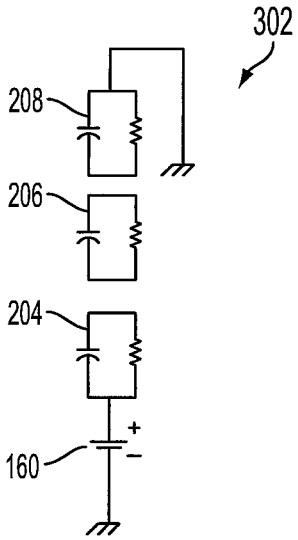
FIG. 3B illustrates an electrical circuit of the biased transfer roll assembly shown in FIG. 3A.

The method 400 also includes measuring the voltage $V_{BTR}$ at the biased transfer roll 109 at 404 using a suitable voltage detector 162. This measurement can be obtained at the output of the power supply 160 operating in constant current mode. If the biased transfer roll 109 is in the non-contact position, shown in FIG. 2A, such that the BTR image transfer nip 300 is in the open condition, the output voltage of the power supply 160 applied to the biased transfer roll nip 300 will be relatively high, higher than if the biased transfer roll 109 is in the contact position (i.e. BTR image transfer nip 300 is in the closed condition), because the power supply 160 will attempt to provide a constant current to the open electrical circuit 302 shown in FIG. 3B. In one non-limiting example, the output voltage of the power supply 160 will rail at maximum voltage when attempting to apply constant current to the biased transfer roll 109 that is in the non-contact position. Alternatively, when supplying constant current from the power supply 160 to the biased transfer roll 109 with the biased transfer roll 109 in the contact position, shown in FIG. 2A, the output voltage of the power supply 160 will be relatively lower, because it is supplying a constant current to the closed electrical circuit 202 shown in FIG. 2B.

It has been determined, therefore, that the condition of the BTR image transfer nip can be determined to be opened 200 or closed 300 using this information. The voltage $V_{BTR}$ measured at 404 is compared to a voltage threshold THR at 406. If the $V_{BTR}$ is greater than the voltage threshold THR, a controller 164 determines, at 408, that the biased transfer roll 109 is in the non-contact position and the BTR image transfer nip is open. The controller 164 can be part of a high voltage power supply, part of the controller 120, or one or more other physical control devices.

If the $V_{BTR}$ is less than the voltage threshold THR, the controller 164 determines, at 410, that the biased transfer roll 109 is in the non-contact position and the BTR image transfer nip is open. In one non-limiting example, the high voltage power supply 160 operating in constant current mode supplies a constant current of about 10 micro amps to about 20 micro amps, to the biased transfer roll 109, though it should be appreciated that other suitable ranges of current can be applied. In the closed position 200, the resistive and capacitive properties 204, 206 and 208 of the respective biased transfer roll 109, intermediate transfer belt 101, and photoreceptor 104C, 104M, 104Y and 104K result in a voltage output of about 800 v, well below the rail voltage of about 3000 v to about 8000 v.

Figure 5:
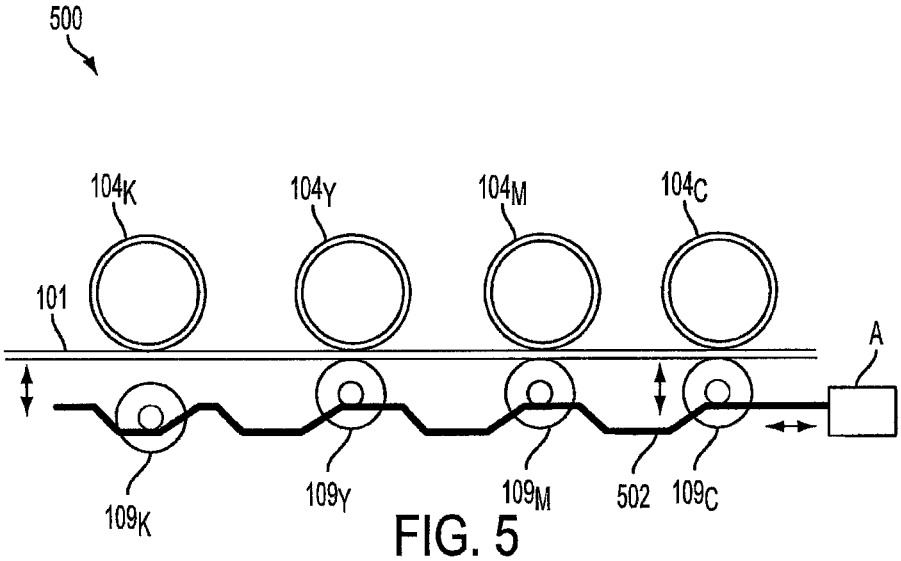
FIG. 5 illustrates an exemplary embodiment of a ganged arrangement of color marking engine biased transfer roll assemblies.

Referring now to FIG. 5, an example of a ganged connection of biased transfer rolls 109 is illustrated generally at 500. A ramped moveable linkage 502 having spaced apart ramped raised portions spatially corresponding to associated biased transfer rolls 109 is connected to an actuator A for moving the linkage 502 laterally. In this example, the cyan marking engine biased transfer roll $\mathbf{109}_C$, magenta marking engine biased transfer roll $\mathbf{109}_M$ and yellow marking engine biased transfer roll $\mathbf{109}_Y$ are ganged together for simultaneous mutual movement between the contact position, shown, in which the cyan, magenta and yellow BTR image transfer nips are in the closed condition, and the non-contact position described below. The closed condition can be determined using the method 400 described above.

The black biased transfer roll $\mathbf{109}_K$ is in the non-contact position forming an open black BTR image transfer nip 300. This can be determined using the method 400 described above.

Lateral displacement of the ramped moveable linkage 502 to the right in FIG. 5 will move the cyan marking engine biased transfer roll $\mathbf{109}_C$, magenta marking engine biased transfer roll $\mathbf{109}_M$ and yellow marking engine biased transfer roll $\mathbf{109}_Y$ to the non-contact position and retain the black marking engine biased transfer roll $\mathbf{109}_K$ there such that all BTR image transfer nips 200 are in the open condition. This can be determined using the method 400 described above.

Lateral displacement of the ramped moveable linkage 502 to the left in FIG. 5 will move the black marking engine biased transfer roll $\mathbf{109}_K$, to the contact position, while retaining the color marking engine biased transfer rolls there, such that all BTR image transfer nips are in the closed condition. This can be determined using the method 400 described above.

Figure 6:
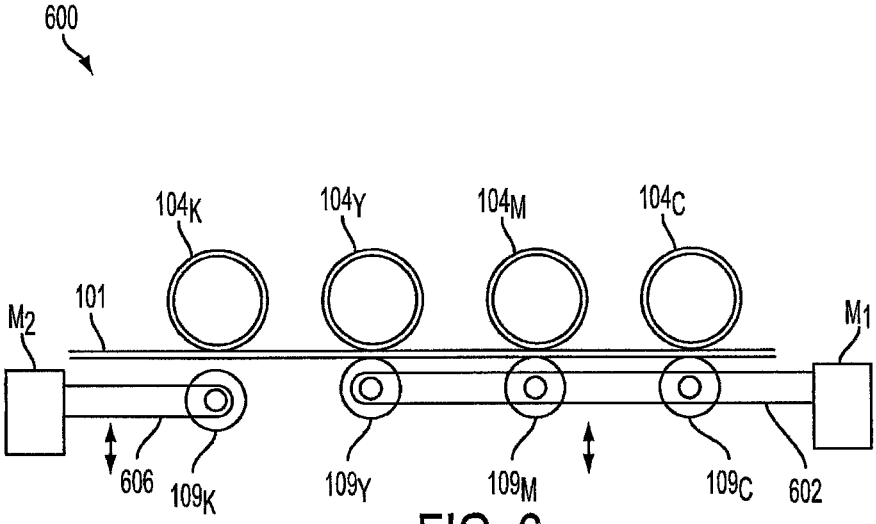
FIG. 6 illustrates another embodiment of a ganged arrangement of color marking engine biased transfer roll assemblies.

Referring now to FIG. 6, another example of a ganged connection of biased transfer rolls 109 is illustrated generally at 600. An actuator $M_1$ is connected to a moveable linkage 602 for moving the linkage 602 vertically. In this example, the cyan marking engine biased transfer roll $\mathbf{109}_C$, magenta marking engine biased transfer roll $\mathbf{109}_M$ and yellow marking engine biased transfer roll $\mathbf{109}_Y$ are ganged together for simultaneous mutual movement between the contact position, shown, in which the cyan, magenta and yellow BTR image transfer nips are in the closed condition and the non-contact position which the cyan, magenta and yellow BTR image transfer nips are in the open condition. The contact or non-contact positions of the color marking engine biased transfer rolls $\mathbf{109}_C$ $\mathbf{109}_M$ $\mathbf{109}_Y$, and the open or closed conditions of the associated color BTR image transfer nips can be determined using the method 400 described above.

FIG. 6 illustrates the black biased transfer roll $\mathbf{109}_K$ in the non-contact position forming an open black BTR image transfer nip. A moveable linkage 606 is connected to the black biased transfer roll $\mathbf{109}_K$. An actuator $M_2$ is connected to the moveable linkage 606 for moving the linkage 606 vertically, thereby moving the black marking engine biased transfer roll $\mathbf{109}_K$ from the non-contact position, to the contact position forming a closed black BTR image transfer nip. The contact or non-contact positions of the black marking engine biased transfer roll $\mathbf{109}_K$, and the open or closed condition of the black BTR image transfer nip can be determined using the method 400 described above.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of determining a location of a biased transfer roll in a printer having an image transfer nip formed by an intermediate transfer surface disposed between a biased transfer roll movable relative to an associated photoreceptor, the method comprising:

connecting a power supply operating in constant current mode to the biased transfer roll;

measuring a voltage directly across the biased transfer roll; and a controller determining the image transfer nip being in an open condition or a closed condition from the voltage measured at the biased transfer roll.

2. The method of claim 1 wherein the determining further comprises:

comparing the voltage to a threshold and determining that the image transfer nip is in the closed condition when the voltage is below the threshold.

3. The method of claim 1 wherein the determining further comprises:

comparing the voltage to a threshold and determining that the image transfer nip is in the open condition when the voltage is above the threshold.

4. The method of claim 1 wherein the image transfer nip is a black image transfer nip.

5. The method of claim 1 wherein the image transfer nip is a color image transfer nip.

6. The method of claim 5 wherein the color image transfer nip is one of a plurality of color image transfer nips.

7. A printer comprising:

a marking engine including:

a photoreceptor having an outer surface, and a biased transfer roll having an outer surface;

an intermediate transfer surface disposed between the photoreceptor outer surface and the biased transfer roll outer surface;

a movable linkage operatively connected to the biased transfer roll and configured to move the biased transfer roll outer surface into contact with the intermediate transfer surface and the intermediate transfer surface into contact with the photoreceptor outer surface forming an image transfer nip in a closed condition, and the moveable linkage being configured to move the biased transfer roll outer surface out of contact with the intermediate transfer surface forming an image transfer nip in an open condition;

a power supply connected to the biased transfer roll for applying a constant current to the biased transfer roll;

a voltage detector connected to the biased transfer roll for measuring a voltage directly across the biased transfer roll; and a controller connected to the voltage detector and configured to evaluate the voltage at the biased transfer roll and determine the image transfer nip being in the open condition or the closed condition.

8. The printer of claim 7 wherein marking engine is a black marking engine.

9. The printer of claim 7 further comprising:

a plurality of marking engines, each marking engine including a photoreceptor having an outer surface, and a biased transfer roll having an outer surface;

wherein the intermediate transfer surface is disposed between the photoreceptor outer surfaces and the biased transfer roll outer surfaces of the plurality of marking engines, and wherein the movable linkage is operatively connected to the biased transfer rolls of the plurality of marking engines and configured to simultaneously move the biased transfer roll outer surfaces into contact with the intermediate transfer surface and the intermediate transfer surface into contact with the photoreceptor outer surfaces forming ganged image transfer nips in a closed condition, and the moveable linkage is configured to simultaneously move the biased transfer roll outer surfaces out of contact with the intermediate transfer surface forming ganged image transfer nips in an open condition, and wherein the power supply is connected to at least one of the biased transfer rolls, and wherein the voltage detector is connected to at least one of the biased transfer rolls for measuring a voltage, and a controller connected to the voltage detector and configured to evaluate a voltage at the at least one of the biased transfer rolls for determining the ganged image transfer nips being in the open condition or the closed condition.

10. The printer of claim 9 wherein the plurality of marking engines include a first color marking engine, a second color marking engine and a third color marking engine.

11. The printer of claim 10 wherein the plurality of marking engines include a cyan marking engine, a magenta marking engine and a yellow marking engine.

12. The printer of claim 11 further comprising a black marking engine including:

a photoreceptor having an outer surface, and a biased transfer roll having an outer surface, wherein the intermediate transfer surface is disposed between the photoreceptor outer surface and the biased transfer roll outer surface of the black marking engine;

a second movable linkage connected to the black marking engine biased transfer roll and configured to move the black marking engine biased transfer roll outer surface into contact with the intermediate transfer surface and the intermediate transfer surface into contact with the black marking engine photoreceptor outer surface forming a black image transfer nip in an open condition, and the second moveable linkage being configured to move the black marking engine biased transfer roll outer surface out of contact with the intermediate transfer surface forming a black image transfer nip in an open condition; and wherein the power supply is connected to the black marking engine biased transfer roll for applying a constant current to the black marking engine biased transfer roll, and the voltage detector is connected to the black marking engine biased transfer roll for measuring a voltage at the black marking engine biased transfer roll, and the controller is connected to the voltage detector and configured to evaluate the voltage at the black marking engine biased transfer roll and determine the black image transfer nip being in the open condition or the closed condition.

13. The printer of claim 7 wherein the intermediate transfer surface is an intermediate transfer belt.

14. A printer subsystem comprising:

a marking engine including:

a photoreceptor having an outer surface, and a biased transfer roll having an outer surface;

an intermediate transfer surface disposed between the photoreceptor outer surface and the biased transfer roll outer surface;

a movable linkage operatively connected to the biased transfer roll and configured to move the biased transfer roll outer surface into contact with the intermediate transfer surface and the intermediate transfer surface into contact with the photoreceptor outer surface forming an image transfer nip in a closed condition, and the moveable linkage being configured to move the biased transfer roll outer surface out of contact with the intermediate transfer surface forming an image transfer nip in an open condition;

a power supply connected to the biased transfer roll for applying a constant current to the biased transfer roll;

a voltage detector connected to the biased transfer roll for measuring a voltage directly across the biased transfer roll; and a controller connected to the voltage detector and configured to evaluate the voltage at the biased transfer roll and determine the image transfer nip being in the open condition or the closed condition.

15. The printer subsystem of claim 14 wherein marking engine is a black marking engine.

16. The printer subsystem of claim 15 further comprising:

a plurality of marking engines, each marking engine including a photoreceptor having an outer surface, and a biased transfer roll having an outer surface;

wherein the intermediate transfer surface is disposed between the photoreceptor outer surfaces and the biased transfer roll outer surfaces of the plurality of marking engines, and wherein the movable linkage is operatively connected to the biased transfer rolls of the plurality of marking engines and configured to simultaneously move the biased transfer roll outer surfaces into contact with the intermediate transfer surface and the intermediate transfer surface into contact with the photoreceptor outer surfaces forming ganged image transfer nips in a closed condition, and the moveable linkage is configured to simultaneously move the biased transfer roll outer surfaces out of contact with the intermediate transfer surface forming ganged image transfer nips in an open condition, and wherein the power supply is connected to at least one of the biased transfer rolls, and wherein the voltage detector is connected to at least one of the biased transfer rolls for measuring a voltage, and a controller connected to the voltage detector and configured to evaluate a voltage at the at least one of the biased transfer rolls for determining the ganged image transfer nips being in the open condition or the closed condition.

17. The printer subsystem of claim 16 wherein the plurality of marking engines include a first color marking engine, a second color marking engine and a third color marking engine.

18. The printer subsystem of claim 16 wherein the plurality of marking engines include a cyan marking engine, a magenta marking engine and a yellow marking engine.

19. The printer of claim 18 further comprising a black marking engine including:

a photoreceptor having an outer surface, and a biased transfer roll having an outer surface, wherein the intermediate transfer surface is disposed between the photoreceptor outer surface and the biased transfer roll outer surface of the black marking engine;

a second movable linkage connected to the black marking engine biased transfer roll and configured to move the black marking engine biased transfer roll outer surface into contact with the intermediate transfer surface and the intermediate transfer surface into contact with the black marking engine photoreceptor outer surface forming a black image transfer nip in an open condition, and the second moveable linkage being configured to move the black marking engine biased transfer roll outer surface out of contact with the intermediate transfer surface forming a black image transfer nip in an open condition; and wherein the power supply is connected to the black marking engine biased transfer roll for applying a constant current to the black marking engine biased transfer roll, and the voltage detector is connected to the black marking engine biased transfer roll for measuring a voltage at the black marking engine biased transfer roll, and the controller is connected to the voltage detector and configured to evaluate the voltage at the black marking engine biased transfer roll and determine the black image transfer nip being in the open condition or the closed condition.

20. The printer subsystem of claim 14 wherein the intermediate transfer surface is an intermediate transfer belt.

* * * * *